United States Patent [19]

Ueda et al.

[11] 4,287,046

[45] Sep. 1, 1981

[54] PROCESS FOR TREATING ELECTROLYTIC SOLUTION AND APPARATUS THEREFOR

[75] Inventors: Kenji Ueda; Akihiro Sakanishi, both of Nagasaki, Japan

[73] Assignee: Mitsubishi Jukogyo Kabushiki Kaisha, Tokyo, Japan

[21] Appl. No.: 125,448

[22] Filed: Feb. 28, 1980

Related U.S. Application Data

[62] Division of Ser. No. 62,531, Jul. 3, 1979.

[30] Foreign Application Priority Data

Aug. 11, 1978 [JP] Japan ..... 53/97995
Jun. 8, 1979 [JP] Japan ..... 54/72106

[51] Int. Cl.[3] ..... C25B 9/00
[52] U.S. Cl. ..... 204/266; 204/282
[58] Field of Search ..... 204/275, 278, 263, 266, 204/128, 89, 234, 282

[56] References Cited

U.S. PATENT DOCUMENTS

| | | | |
|---|---|---|---|
| B 361,744 | 1/1975 | Gritzner | 204/128 X |
| 3,761,369 | 9/1973 | Tirrell | 204/89 X |
| 3,964,990 | 6/1976 | Woyden | 204/275 |
| 4,028,212 | 6/1977 | Bowen et al. | 204/234 X |
| 4,098,668 | 7/1978 | Andersen et al. | 204/275 X |
| 4,144,145 | 3/1979 | Watanabe et al. | 204/89 |

*Primary Examiner*—R. L. Andrews
*Attorney, Agent, or Firm*—Toren, McGeady and Stanger

[57] ABSTRACT

A process for treating an electrolytic solution to recover a concentrated solution from a dilute one in an electrolytic cell or in each of such cells divided by a permeable diaphragm into a feed chamber and a recovery chamber provided, respectively, with positive and negative electrodes or vice versa. A dilute electrolytic solution is fed to the feed chamber, and, while electrolysis is in progress between the electrode of the feed chamber and the electrode held in the recovery chamber in close proximity to, or in intimate contact with, the diaphragm, the electrolyzed solution is allowed to exude through the diaphragm into the recovery chamber, whereby the concentrated solution is extracted into the latter chamber. In the apparatus for practicing the process, either the negative or positive electrode is held in the feed chamber and the other electrode is held in the recovery chamber in close proximity to, or in intimate contact with, the diaphragm. The feed chamber is provided with an inlet for the electrolytic solution to be treated and also with an outlet for the treated solution. The recovery chamber is provided with a jet means for injecting, at the start of the electrolysis, part of the electrolytic solution to be treated against the diaphragm and the latter electrode, a gas outlet through which the gas generated at the electrode during the electrolysis is released, and an acid outlet through which a concentrated electrolytic solution that has exuded into the recovery chamber as a result of the electrolytic treatment is taken out of the vessel.

2 Claims, 10 Drawing Figures

PROCESS FOR TREATING ELECTROLYTIC SOLUTION AND APPARATUS THEREFOR

This is a division of application Ser. No. 62,531, filed on July 3, 1979.

This invention relates to a process and an apparatus for extracting a concentrated electrolytic solution from a dilute one through an electrolytic treatment, and more particularly to a process and an apparatus suited for separating and recovering chromic acid from washings or wastewater from a metal plating plant that contains the particular acid.

Heretofore, a process and an apparatus have been known for treating chromic acid-containing metal plating wastewater by electrolyzing the wastewater in an electrolytic cell partitioned with a diaphragm and recovering chromic acid in an anode chamber and water in a cathode chamber.

The principle of the conventional process is illustrated in FIG. 1. An electrolytic cell 1 is equipped with a diaphragm 2 to divide the space into two, i.e. an anode chamber 3 and a cathode chamber 4, provided with an anode 5 and a cathode 6, respectively. The diaphragm 2, made of permeable glass fiber, porcelain, cloth, porous high polymer or the like, is located to make the anode chamber 3 small as compared with the cathode chamber 4. In the electrolytic system of the arrangements described, metal plating wastewater containing chromic acid is placed in the both chambers and a DC voltage is applied between the two electrodes. This causes migration of chromic acid ions from the cathode chamber 4 to the anode chamber 3, with a consequent decrease in the chromic acid concentration in the cathode chamber to the extent that water can be recovered.

A typical apparatus based upon the principle of the prior art process is shown in FIG. 3. As shown, an electrolytic cell 1 is partitioned by a diaphragm 2 into an anode chamber 3 and a cathode chamber 4, provided with an anode 5 and a cathode 6, respectively. Metal plating wastewater enters the cathode chamber 4 through an inlet pipe 7 and leaves the chamber through an outlet pipe 8 for discharge out of the system or for recycling. Before the electrolytic treatment, part of the plating wastewater is introduced into the anode chamber 3 via an inlet pipe 9 branched off from the inlet pipe 7, and after the treatment chromic acid is taken out through an acid outlet pipe 10. The branch inlet pipe 9 and the acid outlet pipe 10 are equipped with cocks 11 and 12, respectively, which are both closed during the progress of electrolysis.

According to our research, the migration velocity v of chromic acid ions in the apparatus operating on the principle of the conventional process is defined as $$v = K_1 I - K_2 \frac{I}{V_a} t \qquad (1)$$

where I is the electrolysis current, $V_a$ is the volume of the anode chamber, t is the electrolysis time, and $K_1$ and $K_2$ are constants. Thus, if the volume of the anode chamber $V_a$ is reduced in order to increase the chromic acid concentration in the anode chamber 3, the second member in the right side of Eq. (1), i.e., the force of diffusion from the anode chamber, will increase and therefore the migration velocity v of chromic acid ions will decrease. In other words, concentration of the chromic acid will not proceed beyond a certain limit.

The present invention has for its object the provision of a treatment process and an apparatus therefor capable of overcoming the afore-described disadvantage of the prior art.

In accordance with the invention, a process is provided for treated an electrolytic solution to recover a concentrated solution from a dilute one in an electrolytic cell or in each of such cells divided by a permeable diaphragm into a feed chamber and a recovery chamber equipped, respectively, with positive and negative electrodes or vice versa, characterized in that a dilute electrolytic solution is fed to the feed chamber, and, while electrolysis is in progress between the electrode of the feed chamber and the electrode held in the recovery chamber in close proximity to, or in intimate contact with the diaphragm, the electrolyzed solution is allowed to exude through the diaphragm into the recovery chamber, whereby the concentrated electrolytic solution is extracted into the latter chamber.

Also, according to the invention, an apparatus is provided for treating an electrolytic solution to recover a concentrated solution from a dilute one in an electrolytic cell or in each of such cells divided by a diaphragm into a feed chamber equipped, respectively, with positive and negative electrodes or vice versa, characterized in that either the negative or positive electrode is held in the feed chamber and the other electrode is held in the recovery chamber in close proximity to, or in intimate contact with, the diaphragm, the feed chamber is provided with an inlet for the electrolytic solution to be treated and also with an outlet for the treated solution, and the recovery chamber is provided with a jet means for injecting, at the start of the electrolysis, part of the electrolytic solution to be teated against the diaphragm and the latter electrode, a gas outlet through which the gas generated at the electrode during the electrolysis is released, and an acid outlet through which a concentrated electrolytic solution that has exuded into the recovery chamber as a result of the electrolytic treatment is taken out of the vessel.

In the process and apparatus of the invention, the recovery chamber is not filled with the liquid as in the conventional arrangements. Consequently, in the absence of the second chamber in the right side of Eq. (1), i.e., the force of diffusion from the recovery chamber, the migration velocity v of chromic acid ions in the apparatus of the invention is given by $$V = K_1 I \qquad (2)$$

where I is the electrolysis current and $K_1$ is a constant.

The above and other objects, features, and advantages of the invention will become more apparent from the following description taken in conjunction with the accompanying drawings, in which.

The process of the invention will now be described as applied to the treatment of an electrolytic solution in the form of metal plating washings or wastewater containing chromic acid.

Figure 1:
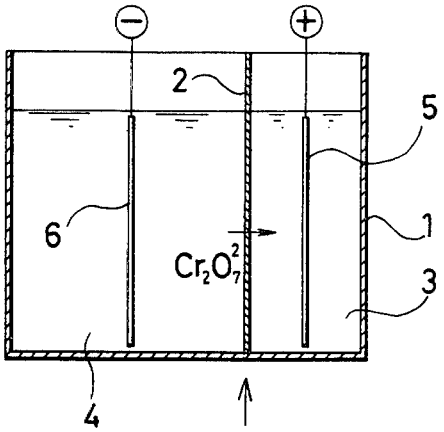
FIG. 1 is a schematic view illustrating the principle of a conventional process.
Figure 2:
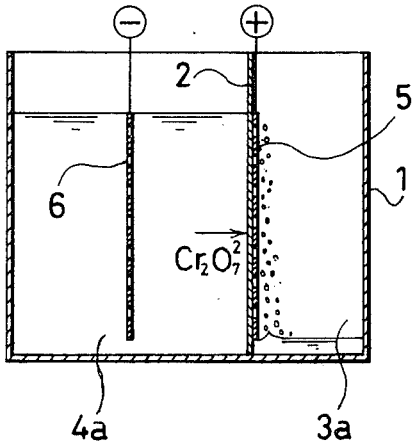
FIG. 2 is a schematic view illustrating the principle of the process according to the invention.
Figure 3:
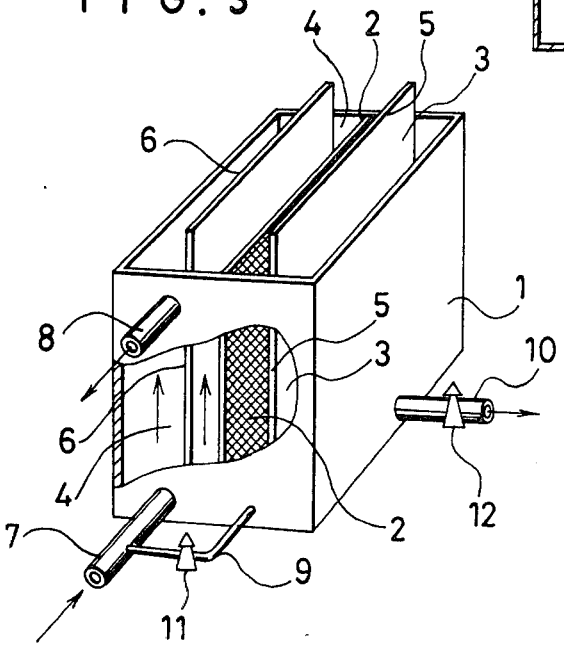
FIG. 3 is a partly broken perspective view of a conventional apparatus.

The principle of the process will be first explained in connection with FIG. 2. As shown, an electrolytic cell 1 is partitioned by a separator or diaphragm 2 into a recovery chamber 3*a* and a feed chamber 4*a*. Inside the recovery chamber 3*a*, an anode 5 is provided in intimate contact with, or close to, the diaphragm 2. Inside the feed chamber 4*a*, a cathode 6 is held in close contact with, or apart from, the diaphragm. The diaphragm 2 is made of permeable glass fiber, porcelain cloth, porous polymer or the like, and the anode 5 and the cathode 6 are formed of porous or solid (nonporous) metal or the like. When a porous anode 5 is to be used, it may be attached intimately to the diaphragm 2 because the liquid extract will exude through the pores. When the anode is solid, it is held in close proximity to the diaphragm 2 so that the extract may be forced out by a capillary action. Similarly, a porous cathode 6 may be held in direct contact with a diaphragm 2, whereas a solid cathode is held apart from the latter. In the electrolytic system of the arrangements described, metal plating wastewater is introduced into the feed chamber 4*a* (instead of the recovery chamber 3*a* as in the conventional process), and a DC voltage is applied between the two electrodes. The, the ions of chromic acid migrate through the diaphragm 2 to the anode section in the recovery chamber 3*a*, with consequent extraction of a concentrated chromic acid solution into the chamber. The solution thus extracted is not collected or stored in the recovery chamber 3*a* but is soon taken out for recovery.

Figure 4:
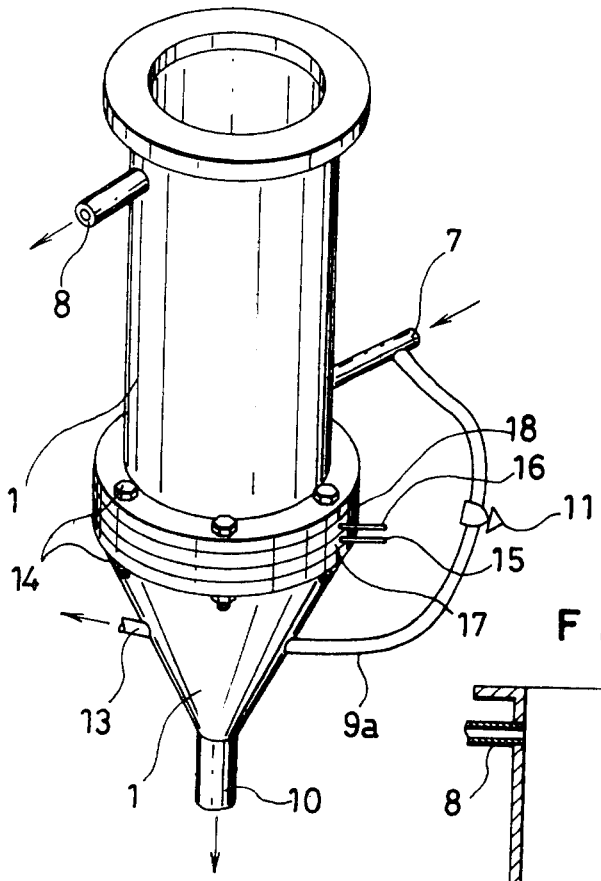
FIG. 4 is a perspective view of a treating apparatus embodying the invention.
Figure 5:
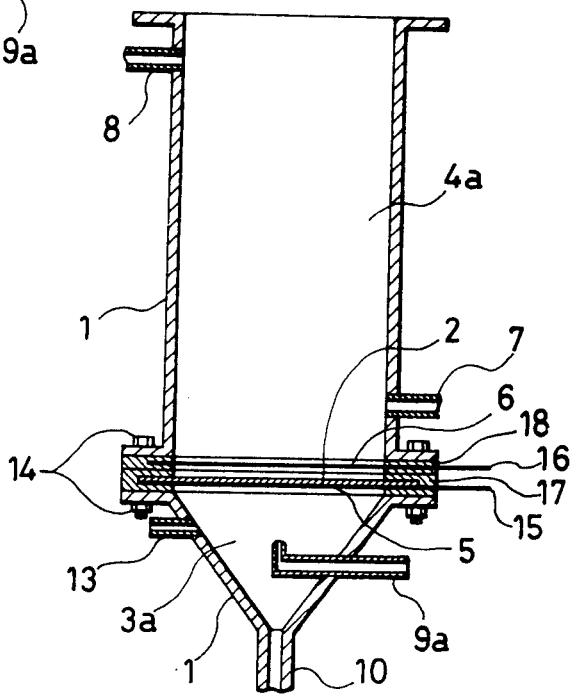
FIG. 5 is a vertical sectional view of the apparatus shown in FIG. 4.
Figure 6:
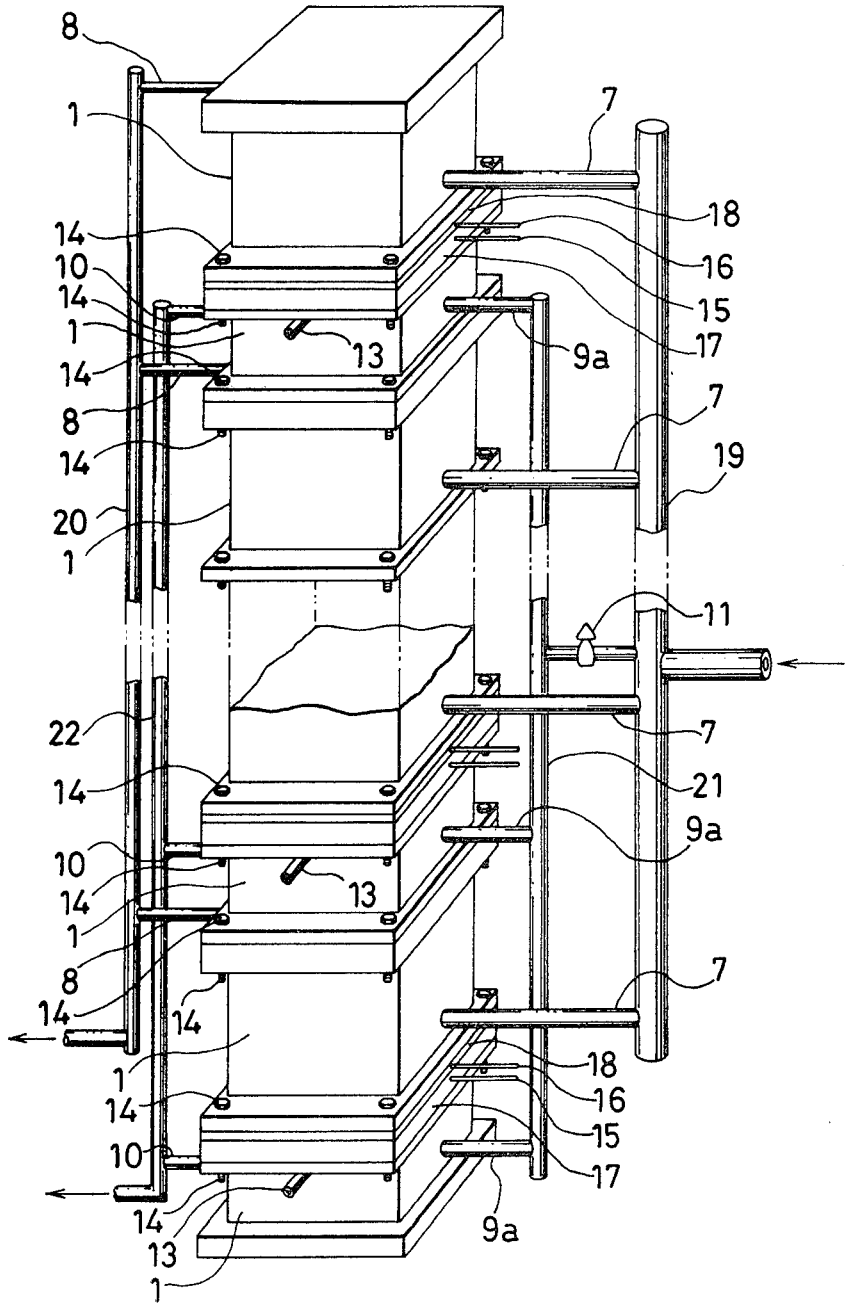
FIG. 6 is a perspective view of another embodiment of the invention.
Figure 7:
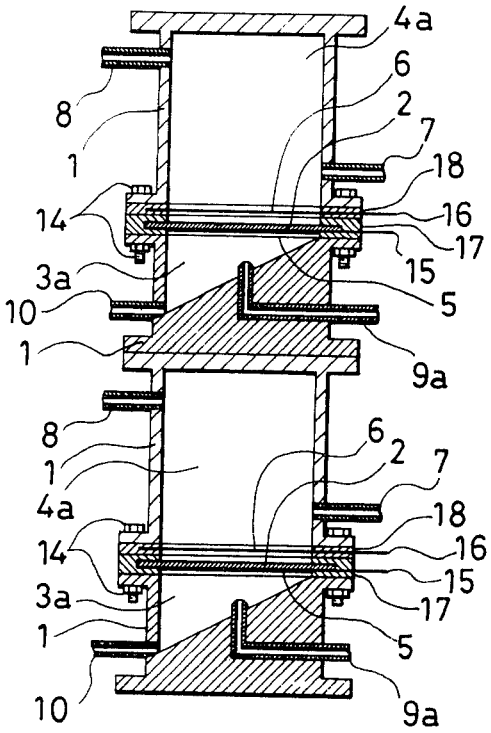
FIG. 7 is a sectional view, with partial omission, of the apparatus shown in FIG. 6.
Figure 8:
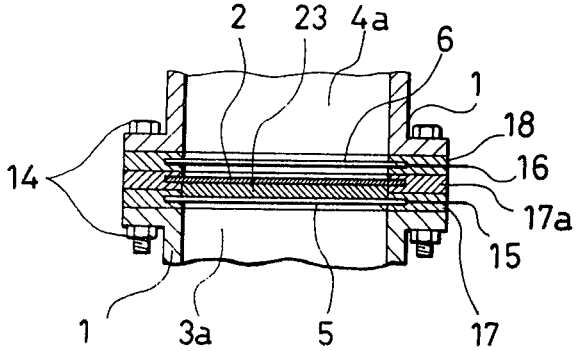
FIG. 8 is a fragmentary sectional view of an apparatus, with an absorbent layer sandwiched between flanged portions in accordance with the invention.

The principle of the invention is embodied in apparatus shown in FIGS. 4 through 8, in which FIGS. 6 and 7 show several units of the embodiment of FIGS. 4 and 5 combined together vertically. In each unit an electrolytic cell 1 has a flanged feed chamber 4*a* in the upper part and a flanged recovery chamber 3*a* in the lower part, with a diaphragm 2 held between the two chambers by bolts and nuts 14 fastening the flanges together. On the recovery chamber side of the diaphragm 2, an anode 5 having a terminal 15 is held in intimate contact with, or close to, the diaphragm by a retainer 17, and on the feed chamber side, a cathode 6 having a terminal 16 is held in close contact with, or apart from, the diaphragm by a retainer 18. Where the diaphragm and/or the anode is of such material that is unable by nature to release the gas produced or recover chromic acid satisfactorily, an absorbent layer 23 as shown in FIG. 8 may be sandwiched between the diaphragm 2 and the anode 5. The absorbent material which takes up the acid assists in its effective recovery. Metal plating wastewater enters the feed chamber 4*a* through an inlet pipe 7 and leaves the system through an outlet pipe 8 for discharge or recycling. Before the electrolytic treatment, part of the plating wastewater supplied through a jet pipe 9*a* branched from the inlet pipe 7 is issued against the anode 5 and the diaphragm 2. While electrolysis is in progress, chromic acid is taken out through an acid outlet pipe 10. The branched jet pipe 9*a* is equipped with a cock 11, which is kept closed during the treatment. The gas generated at the anode is released through a gas outlet pipe 13. In the multi-unit apparatus shown in FIGS. 6 and 7, the inlet pipes 7, outlet pipes 8, branched jet pipes 9*a*, and acid outlet pipes 10 of the units, each of the construction illustrated in FIGS. 4 and 5, are connected in parallel to manifold pipes, i.e., an inlet header 19, outlet header 20, jet header 21, and acid outlet header, respectively.

As the apparatus carries out electrolysis of the plating wastewater being continuously fed to each feed chamber 4*a*, a highly concentrated chromic acid solution can be continuously recovered from each recovery chamber 3*a*.

The invention is illustrated by the following example.

An electrolytic cell was built of two parts, the upper part being a cylinder 50 cm in diameter which formed a feed chamber, and the lower part an inverted cone 50 cm in maximum diameter which formed a recovery chamber. Between the two chamber was interposed a diaphragm of vinyl chloride type porous high polymer having a porosity of 35%, each poe measuring 0.3 mm across. Close to the upper surface of the diaphragm, a porous cathode consisting of a 20-mesh screen of stainless steel was held, and a porous anode of a 20-mesh platinum screen was provided in intimate contact with the under surface of the diaphragm. For a satisfactory electrolysis, a water-absorbing layer of laminated cotton cloth was sandwiched between the diaphragm and the porous anode. The feed chamber was communciated with a tank for recycling the metal plating wastewater, and the recovery chamber was provided with an outlet through which a concentrated acid solution was to be discharged.

Figure 9:
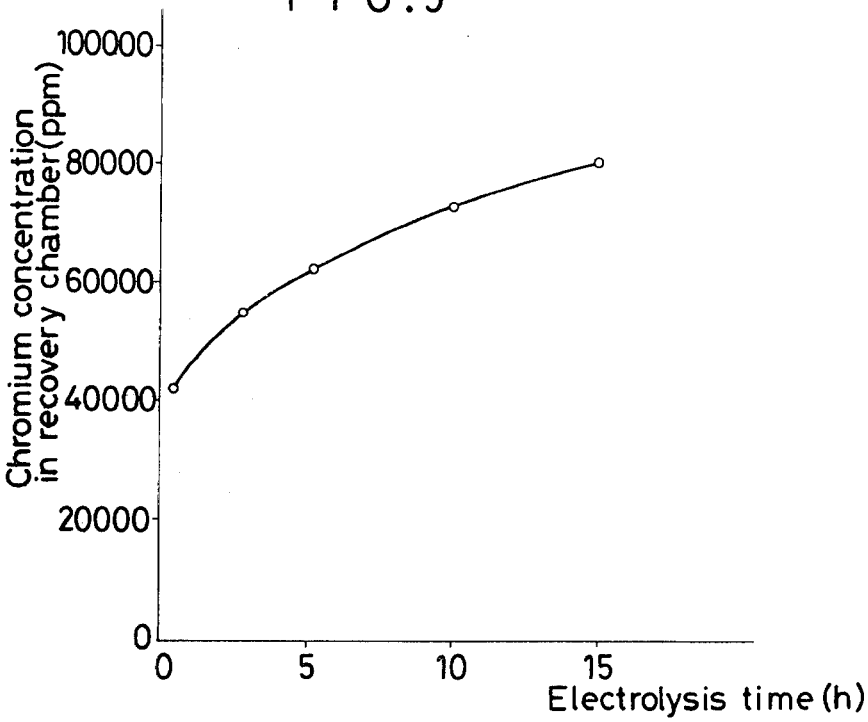
FIGS. 9 and 10 are graphs showing changes in chromium concentration with passage of electrolysis time in the recovery and feed chambers, respectively.
Figure 10:
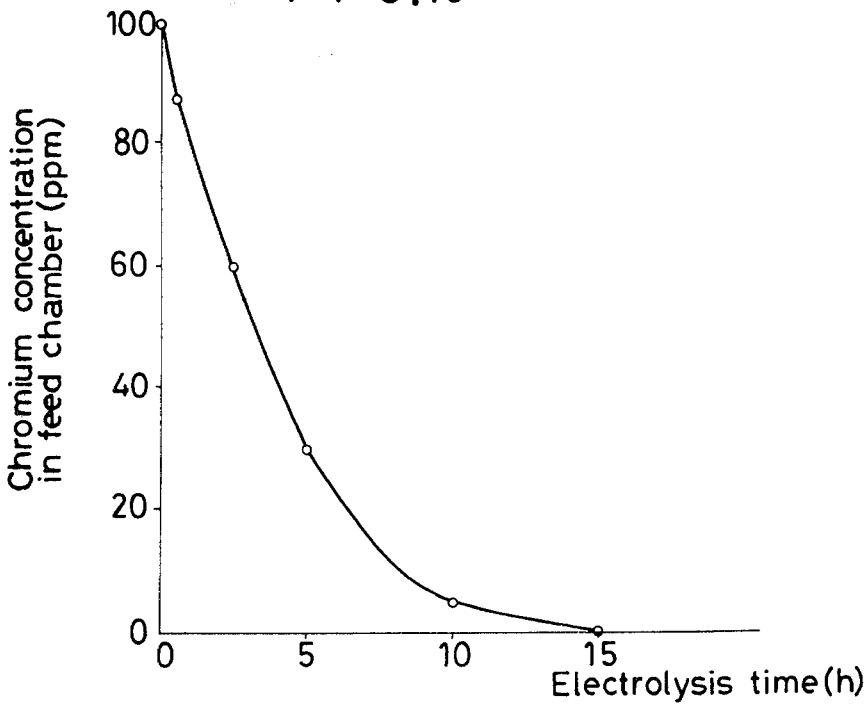

With the electrolytic cell of the construction described above, metal plating wastewater containing chromium in a concentration of 100 ppm was supplied from the tank to the feed chamber, and the diaphragm, water-absorbing material, and porous anode were thoroughly soaked with the plating wastewater, and then electrolysis was carried out for 15 hours with an electrolysis current of 60 A (the current density across the diaphragm being 30 $mA/cm^2$), while one cubic meter of the wastewater was being recycled between the feed chamber and the tank. In the recovery chamber 1.2 l of a chromic acid solution with a chromium concentration of 80,000 ppm was obtained. During this, the concentration of chromium in the feed chamber and the tank was 0.1 ppm, and the power consumption required for the electrolysis was 25 kWh. The changes with the passage of electrolysis time in the concentrations of chromium in the recovery and feed chambers were as plotted, respectively, in FIGS. 9 and 10.

As described above, the process and apparatus of the invention render it possible to obtain a thick chromic acid solution with a chromium concentration of as much as about 80,000 ppm from the washings or wastewater from the plating industry having a chromic concentration of about 100 ppm, with substantially the same power consumption as by the ordinary process and apparatus for the treatment. In this respect, the process and apparatus of the invention are decidedly superior to the conventional ones whereby chromic acid solutions containing at most from about 5,000 to 10,000 ppm of chromium are obtained.

Although the present invention has been described as applied to the recovery of chromic acid from metal plating wastewater that contains the acid, it is useful in other applications as well, for example, in recovering thick alkalis from dilute salt water. In the latter case it is only necessary to replace the anode in the above mentioned position with the cathode, and vice versa.

As will be obvious from the foregoing, the process and apparatus of the invention are of exceedingly high industrial value because of the ability to handle wastewater from varied industrial sources.

What is claimed is:

1. An apparatus for treating an electrolytic solution to recover a concentrated solution from a dilute one in an electrolytic cell or in each of such cells divided by a diaphragm into a feed chamber and a recovery chamber provided, respectively, with positive and negative electrodes or vice versa, characterized in the either the negative or positive electrode is held in said feed chamber and the other electrode is held in said recovery chamber in close proximity to, or in intimate contact with, said diaphragm, said feed chamber is provided with an inlet for the electrolytic solution to be treated and also with an outlet for the treated solution, and said recovery chamber is provided with jet means for injecting, at the start of the electrolysis, part of said electrolytic solution to be treated against said diaphragm and said latter electrode, a gas outlet through which the gas generated at said electrode during the electrolysis is released, and an acid outlet through which a concentrated electrolytic solution that has exuded into said recovery chamber as a result of said electrolytic treatment is taken out of the vessel.

2. An apparatus according to claim 1, characterized in that an absorbent layer is sandwiched between said diaphragm and said electrode in said recovery chamber.

* * * * *